US009458626B2

(12) United States Patent
Hohmann, Jr. et al.

(10) Patent No.: US 9,458,626 B2
(45) **Date of Patent: *Oct. 4, 2016**

(54) LASER CONFIGURED COLUMN ANCHORS AND ANCHORING SYSTEMS UTILIZING THE SAME

(71) Applicant: Columbia Insurance Company, Omaha, NE (US)

(72) Inventors: Ronald P. Hohmann, Jr., Hauppauge, NY (US); Ronald P. Hohmann, Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/788,540

(22) Filed: Mar. 7, 2013

(65) Prior Publication Data

US 2014/0250814 A1 Sep. 11, 2014

(51) Int. Cl.
*E04B 1/41* (2006.01)
*E04G 21/14* (2006.01)

(52) U.S. Cl.
CPC ..... *E04B 1/4178* (2013.01); *E04G 21/142* (2013.01)

(58) Field of Classification Search
CPC ..... E04B 1/4178; E04G 21/142
USPC ..... 52/379, 513, 506.05, 506.06, 715, 52/506.08
See application file for complete search history.

(56) References Cited

U.S. PATENT DOCUMENTS

| | | | | | |
|---|---|---|---|---|---|
| 364,241 | A | * | 6/1887 | Frost | 52/564 |
| 585,628 | A | * | 6/1897 | Meserve | E04B 1/41 52/714 |
| 819,869 | A | | 5/1906 | Dunlap | |
| 903,000 | A | | 11/1908 | Priest, Jr. | |
| 1,725,200 | A | * | 8/1929 | Lampert | 52/379 |
| 1,794,684 | A | | 3/1931 | Handel | |
| 1,929,835 | A | * | 10/1933 | Awbrey | 52/709 |
| 1,933,536 | A | * | 11/1933 | Awbrey | 52/708 |
| 1,934,760 | A | * | 11/1933 | Awbrey | 52/710 |

(Continued)

FOREIGN PATENT DOCUMENTS

| | | | | |
|---|---|---|---|---|
| AU | 751863 | * | 6/1999 | B66F 19/00 |
| CH | 279209 | | 3/1952 | |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brent W Herring
(74) *Attorney, Agent, or Firm* — Silber & Fridman

(57) ABSTRACT

A high-strength laser configured column anchor and anchoring system is disclosed. The high-strength column anchor provides high-strength pullout resistance when embedded within the wall bed joint. Specially-configured apertures, edging and dimension restrictions provide for flow-through mortar embedment within the wall bed joint. The edging provides irregular and regular patterns ensuring a secure fit within the bed joint. The column anchors include a flat and rotated form for secure attachment to the column flanges and optionally include a securement bar or clamp to further secure the column anchor to the column flanges.

15 Claims, 6 Drawing Sheets

(56) References Cited

U.S. PATENT DOCUMENTS 2,058,148 A 10/1936 Hard
2,300,181 A 10/1942 Spaight
2,403,566 A 7/1946 Thorp et al.
2,413,772 A 1/1947 Morehouse
2,605,867 A 8/1952 Goodwin
2,611,459 A * 9/1952 Hammitt et al. ..... 52/713
2,780,936 A 2/1957 Hillberg
2,929,238 A 3/1960 Kaye
2,966,705 A 1/1961 Massey
2,999,571 A 9/1961 Huber
3,030,670 A 4/1962 Bigelow
3,155,206 A * 11/1964 Booth ..... 52/506.06
3,183,628 A 5/1965 Smith
3,254,736 A 6/1966 Gass
3,277,626 A 10/1966 Brynjolfsson et al.
3,279,720 A 10/1966 Garrett
3,309,828 A 3/1967 Tribble
3,341,998 A 9/1967 Lucas
3,377,764 A 4/1968 Storch
3,563,131 A 2/1971 Ridley
3,568,389 A 3/1971 Gulow
3,964,226 A 6/1976 Hala et al.
4,021,990 A 5/1977 Schwalberg
4,022,537 A * 5/1977 Gilb et al. ..... 403/386
4,173,856 A * 11/1979 Fricker ..... 52/125.5
4,227,359 A * 10/1980 Schlenker ..... 52/713
4,305,239 A 12/1981 Geraghty
4,373,314 A 2/1983 Allan
4,438,611 A 3/1984 Bryant
4,473,984 A 10/1984 Lopez
4,482,368 A 11/1984 Roberts
4,596,102 A 6/1986 Catani et al.
4,598,518 A 7/1986 Hohmann
4,636,125 A 1/1987 Burgard
4,722,163 A * 2/1988 Thornton et al. ..... 52/713
4,738,070 A 4/1988 Abbott et al.
4,764,069 A 8/1988 Reinwall et al.
4,765,108 A * 8/1988 Lapish ..... 52/379
4,819,401 A 4/1989 Whitney, Jr.
4,827,684 A 5/1989 Allan
4,843,776 A 7/1989 Guignard
4,869,038 A 9/1989 Catani
4,869,043 A 9/1989 Hatzinikolas et al.
4,875,319 A 10/1989 Hohmann
4,955,172 A 9/1990 Pierson
5,035,099 A * 7/1991 Lapish ..... 52/713
5,042,219 A * 8/1991 Fricker ..... 52/707
5,063,722 A 11/1991 Hohmann
5,099,628 A 3/1992 Noland et al.
5,207,043 A 5/1993 McGee et al.
5,390,460 A * 2/1995 Llorens ..... 52/489.1
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A * 10/1995 Anderson et al. ..... 52/713
5,490,366 A 2/1996 Burns et al.
5,522,187 A * 6/1996 Bogaerts ..... 52/90.1
5,560,156 A * 10/1996 McDonald ..... E04B 1/2608 403/232.1
5,598,673 A 2/1997 Atkins
5,634,310 A 6/1997 Hohmann
5,669,592 A 9/1997 Kearful
5,671,578 A 9/1997 Hohmann
5,755,070 A 5/1998 Hohmann
5,816,008 A 10/1998 Hohmann
6,148,576 A * 11/2000 Janopaul, Jr. ..... 52/426
6,209,281 B1 4/2001 Rice
6,212,841 B1 * 4/2001 Plume ..... 52/513
6,279,283 B1 8/2001 Hohmann et al.
2,398,630 A1 10/2001 VeRost et al.
6,332,300 B1 12/2001 Wakai
6,351,922 B1 3/2002 Burns et al.
6,510,666 B1 * 1/2003 Thompson ..... E04B 1/2608 52/264
6,668,505 B1 12/2003 Hohmann et al.
6,729,079 B2 * 5/2004 Francies et al. ..... 52/125.4
6,735,915 B1 5/2004 Johnson, III
6,739,105 B2 5/2004 Fleming
6,789,365 B1 9/2004 Hohmann et al.
6,851,239 B1 2/2005 Hohmann et al.
6,925,768 B2 8/2005 Hohmann et al.
6,941,717 B2 9/2005 Hohmann et al.
7,017,318 B1 3/2006 Hohmann et al.
7,111,432 B2 * 9/2006 Hansort ..... 52/125.4
7,152,382 B2 12/2006 Johnson, III
7,171,788 B2 2/2007 Bronner
D540,657 S * 4/2007 Hansort ..... D8/354
7,325,366 B1 2/2008 Hohmann, Jr. et al.
7,415,803 B2 8/2008 Bronner
7,562,506 B2 7/2009 Hohmann, Jr.
7,587,874 B2 9/2009 Hohmann, Jr.
7,845,137 B2 12/2010 Hohmann, Jr.
8,037,653 B2 10/2011 Hohmann, Jr.
8,051,619 B2 11/2011 Hohmann, Jr.
8,192,125 B2 * 6/2012 Ollis et al. ..... 411/454
8,209,934 B2 7/2012 Pettingale
D686,486 S * 7/2013 Densmore et al. ..... D8/349
8,806,815 B1 * 8/2014 Liu ..... H01L 31/0422 248/295.11
8,904,731 B2 * 12/2014 Hohmann et al. ..... 52/714
2001/0054270 A1 12/2001 Rice
2003/0188499 A1 * 10/2003 Bronner ..... 52/378
2004/0083667 A1 5/2004 Johnson, III
2004/0216408 A1 11/2004 Hohmann, Jr.
2004/0216413 A1 11/2004 Hohmann et al.
2004/0216416 A1 11/2004 Hohmann et al.
2005/0279043 A1 12/2005 Bronner
2006/0198717 A1 9/2006 Fuest
2006/0248813 A1 * 11/2006 Fletcher et al. ..... 52/125.4
2008/0115439 A1 * 5/2008 Tamlyn ..... 52/379
2008/0141605 A1 6/2008 Hohmann
2008/0196324 A1 * 8/2008 Mackay Sim ..... 52/125.4
2008/0203270 A1 * 8/2008 Connell et al. ..... 249/94
2009/0133357 A1 5/2009 Richards
2010/0037552 A1 2/2010 Bronner
2010/0071307 A1 3/2010 Hohmann, Jr.
2010/0101175 A1 4/2010 Hohmann
2010/0257803 A1 10/2010 Hohmann, Jr.
2011/0047919 A1 3/2011 Hohmann, Jr.
2011/0146195 A1 6/2011 Hohmann, Jr.
2011/0173902 A1 7/2011 Hohmann, Jr. et al.
2011/0277397 A1 11/2011 Hohmann, Jr.

FOREIGN PATENT DOCUMENTS

CH 643024 A5 * 5/1984 ..... E04B 2/30
GB 2069024 A 8/1981

OTHER PUBLICATIONS

Building Envelope Requirements for Commercial and High Rise Residential Buildings, 780 CMR sec. 1304.0 et seq. of Chapter 13, Jan. 1, 2001, 19 pages, Boston, Massachusetts, United States.
Building Code Requirements for Masonry Structures, TMS 402-11/ACI 530-11/ASCE 5-11, Chapter 6, 12 pages.
Hohmann & Barnard, Inc.; Product Catalog, 2009, 52 pages, Hauppauge, New York, United States.
Canadian Examiners Report for 2,844,459, Mar. 14, 2016, 4 pages.

* cited by examiner

LASER CONFIGURED COLUMN ANCHORS AND ANCHORING SYSTEMS UTILIZING THE SAME

BACKGROUND OF THE INVENTION

1. Field of the Invention

This invention relates to an improved anchoring arrangement for use in conjunction with building construction having a masonry wall secured to a steel building column support. More particularly, the invention relates to construction accessory devices, namely, specially-configured column anchors with laser carve-outs that provide high strength pullout resistance when secured to the columns and within the masonry wall bed joints. The invention is applicable to structures having walls constructed from brick, block or stone in combination with building column support.

2. Description of the Prior Art

In the past, investigations relating to the effects of various forces, particularly lateral forces, upon brick veneer masonry construction demonstrated the advantages of having high-strength anchoring components embedded in the bed joints of anchored veneer walls, such as facing brick, block or stone veneer. Anchors are generally placed in one of the following five categories: corrugated; sheet metal; wire; two-piece adjustable; or joint reinforcing. The present invention has a focus on flat-sheet metal material and in particular, single construct column anchors for cavity wall construction having steel column supports.

The use of steel for the construction of building wall supports have become increasingly popular since its inception in the late 1800s. In the 1940s, veneer construction with steel frames was introduced and its popularity has grown steadily since its introduction. This popularity results from the inherent benefits of steel, as opposed to masonry or wood construction. Steel is one of the strongest building frame materials available and is significantly safer, in that it is not susceptible to insect infestation, rotting or destruction from fire. The high strength of a steel structure provides greater resiliency against the effects of aggressive weather. Steel structures are also more cost effective, providing ease of construction and transport and requiring less material than timber or block methods. Steel is also an environmentally-friendly construction material because it is recyclable and results in less raw material waste. Laser cutting of the column anchor is performed by directing the output of a high-power laser, by computer, to melt, burn, or vaporize the desired configuration of the apertures and cut-outs. Examples of lasers used in the laser cutting herein include, but are not limited to, the $CO_2$ laser (and its variants), and the neodymium and neodymium yttrium-aluminium-garnet laser. Laser carving provides the ability to make the detailed carve-outs in the high-strength metals to form the presently presented column anchors. Laser cutting provides advantages over mechanical cutting or plasma cutting because the workholding is easier and there is reduced contamination of the workpiece (there is no cutting edge). Precision is also improved because there is no wear of the cutting edge in the process and the structural integrity of the high-strength metal is uncompromised.

Anchoring systems for wall construction come in varied forms depending on the wall materials and structural use. Ronald P. Hohmann and Hohmann & Barnard, Inc., now a MiTek-Berkshire Hathaway company, have successfully commercialized numerous devices to secure wall structures, providing improvements that include increases in interconnection strength, ease of manufacture and use, and thermal isolation. The present invention is an improvement in interconnection strength and increased pullout prevention.

The high-strength laser configured column anchors of this invention are specially designed to prevent anchor pullout from the masonry wall. The configured anchors are specially-constructed to restrict movement and ensure a high-strength connection and transfer of forces between the steel columns and masonry veneer wall. The column anchor insertion portion, for disposition within the masonry wall, is laser configured to ensure full mortar coverage within the masonry wall bed joint and prevent anchor pullout, while maintaining the requirements for mortar tolerances set forth in the Building Code Requirements for Masonry Structures, Chapter 6, Veneer. The close control of the overall dimensions of the insertion portion permits the mortar of the bed joints to flow through, over and about the anchor to secure against the laser configurations. Because the anchor hereof employs extra strong material and benefits from the laser configuration of the metal, the anchoring system meets the unusual requirements demanded in current building structures.

There have been significant shifts in public sector building specifications which have resulted in architects and architectural engineers requiring larger and larger cavities in the exterior walls of public buildings. These requirements are imposed without corresponding decreases in wind shear and seismic resistance levels or increases in mortar bed joint height. Thus, the wall anchors needed are restricted to occupying the same ⅜-inch bed joint height in the masonry wall. Because of this, the masonry wall material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

The use of anchors in wall construction have been limited by the mortar layer thicknesses which, in turn are dictated either by the new building specifications or by pre-existing conditions, e.g., matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block to protect against wythe separation. A balancing of mortar and wall anchor dimensions needs to be struck to ensure wall anchor stability within the masonry wall. The present high strength column anchor greatly assists in maintaining this balance in the mortar joint. The presently presented column anchor provides the required high-strength interconnection within the allowed tolerances.

Besides earthquake protection requiring high-strength anchoring systems, the failure of several high-rise buildings to withstand wind and other lateral forces has resulted in the promulgation of more stringent Uniform Building Code provisions. This high-strength laser configured wall anchor is a partial response thereto. The inventor's related anchoring system products have become widely accepted in the industry.

The following patents are believed to be relevant and are disclosed as being known to the inventor hereof:

| U.S. Patent No. | Inventor | Issue Date |
|---|---|---|
| 4,021,990 | Schwalberg | May 10, 1977 |
| 4,473,984 | Lopez | Oct. 2, 1984 |
| 4,598,518 | Hohmann | Jul. 8, 1986 |
| 4,875,319 | Hohmann | Oct. 24, 1989 |
| 6,298,630 | VeRost, et al. | Oct. 9, 2001 |
| 6,739,105 | Fleming | May 25, 2004 |
| 7,171,788 | Bronner | Feb. 6, 2007 |

U.S. Pat. No. 4,021,990—Schwalberg—Issued May 10, 1977 Discloses a dry wall construction system for anchoring a facing veneer to wallboard/metal stud construction with a pronged sheetmetal anchor. The wall tie is embedded in the exterior wythe and is not attached to a straight wire run.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—Hohmann—Issued Jul. 8, 1986 Discloses a dry wall construction system with wallboard attached to the face of studs which, in turn, are attached to an inner masonry wythe. Insulation is disposed between the webs of adjacent studs.

U.S. Pat. No. 4,875,319—Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 6,298,630—VeRost, et al.—Issued Oct. 9, 2001 Discloses a wall plate for attaching a horizontal or sloping beam to a vertical masonry wall. The wall plate is attached through the use of an anchor affixed to a steel beam. A method of attaching a horizontal or sloping beam to a vertical masonry wall is further disclosed.

U.S. Pat. No. 6,739,105—Fleming—Issued May 25, 2004 Discloses a construction assembly which includes a structure panel, with structural members and integrally molded insulation, a floor support, joists and a horizontal ledge. The assembly further includes cut-out tabs and wall anchors and ties interconnected therewith and secured to the assembly.

U.S. Pat. No. 7,171,788—Bronner—Issued Feb. 6, 2007 Discloses masonry connectors for embedment in masonry wall mortar beds and interconnection with a vertical sliding rail attached to a steel frame. The device, when installed, is designed to be embedded in mortar along the cross ribs of the masonry block and does not require grouting in the cells of the masonry units.

None of the above anchors or anchoring systems provide a laser configured column wall anchor with enhanced interconnection properties and pullout resistance. This invention relates to an improved anchoring arrangement for use in conjunction with building construction having a masonry wall secured to a steel building column support and meets the heretofore unmet need described above.

SUMMARY

In general terms, the invention disclosed hereby is a laser configured column anchor and anchoring system for use in anchoring a masonry wall to a steel column structure. The system includes a specially-configured laser-cut metal column anchor that provides high-strength interconnection and superior pullout resistance when embedded in mortar within the bed joint of the masonry wall. The column anchor is designed to fill no more than one half the height of the bed joint to ensure construction in accordance with the applicable engineering standards and guidelines. The close control of overall heights permits the mortar of the bed joints to flow over and through the column anchors.

In this invention, the column anchor is constructed from steel or similar high-strength material. In the first embodiment, the column anchor is a substantially flat device with laser carve-outs and edging. The column anchor is affixed to the steel column flange and inserted in the bed joint of the masonry wall. The masonry block cells and bed joint are filled with mortar, completely surrounding the insertion portion of the column anchor. The column anchor of this embodiment may be fashioned for interchangeable use as a right-sided or left-sided anchor and is for use either as a single anchor affixed to one of edge of the flange or in conjunction with a second anchor, providing attachments to both edges of the column flange.

The second embodiment includes a column anchor having a rotated portion and an offset attachment portion. The offset attachment provides greater contact areas with the column flange, while the rotated portion provides an insertion portion that is substantially parallel to the wall bed joint. The column anchors of this embodiment are for use as a single device or in conjunction with a second column anchor. The column anchors either have a right-sided or left-sided orientation. Similar to the first embodiment, the insertion portion is laser-carved providing specially-configured apertures and edging for high-strength pullout resistance when embedded within the wall bed joint.

The third embodiment includes column anchors similar to the second, but provides a slot in the attachment portion for interconnection with a clamp, when a single column anchor is employed, and a securement bar, when two column anchors are secured to the column flanges. Affixing hardware is employed to secure the clamp and the bar to the column anchor(s).

It is an object of the present invention to provide in an anchoring system having a masonry wall anchored to a steel column support construct, a high-strength column anchor, which includes a laser configured insertion portion.

It is another object of the present invention to provide a specialized column anchor that is configured to provide a high-strength interlock between the steel columns and the adjacent wall.

It is another object of the present invention to provide labor-saving devices to simplify installations of brick, block and stone walls and the securement thereof to a steel columns support structure.

It is a further object of the present invention to provide an anchoring system for a wall comprising a single component that is economical to manufacture resulting in a relatively low unit cost.

It is a feature of the present invention that when the column anchor is installed within the masonry wall bed joint and the bed joint mortar surrounds the laser configurations and apertures, the column anchor provides a high strength interconnection with the steel column supports and pullout resistance.

It is another feature of the present invention that the column anchors are utilizable with a wall of masonry block having aligned or unaligned bed joints.

It is yet another feature of the present invention that the column anchor provides a high-strength interconnection within the allowable tolerances for mortar joint anchoring systems.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

In the embodiments described herein, the column anchors are laser configured to have a thickness of no greater than one-half the bed joint height in the masonry wall thereby becoming better suited to building structures having a masonry wall anchored to adjacent building columns requiring greater pullout resistance. It has been found that the laser configured column anchors, once secured within the mortar joints of the wall, provide a superior interconnect between the wall and the adjacent building column support than the prior art. Before proceeding to the detailed description, the following definitions are provided. For purposes of defining the invention at hand, a volumetric construction unit ("VCU") is a masonry unit constructed with mortar joints between each adjacent unit. A VCU includes, but is not limited to, masonry blocks, bricks, stone or similar material. Further, a building column is a high strength column or I-beam constructed of steel or similar material and having an "I" shape with a set of flanges and an interior web interconnecting the flanges.

The description which follows is of three embodiments of column anchors and anchoring systems utilizing the laser configured column anchor devices of this invention, which devices are suitable for various wall applications. Although each column anchor is adaptable to varied backup structures, the embodiments here apply to walls constructed with VCUs anchored to a building column support structure. For the masonry structures, mortar bed joint thickness is at least twice the thickness of the embedded anchor.

In accordance, with the Building Code Requirements for Masonry Structures, ACI 530-05/ASCE 5-05/TMS 402-05, Chapter 6, each structure forming the wall is designed to resist individually the effects of the loads imposed thereupon. Further, the veneer (outer masonry wall) is designed and detailed to accommodate differential movement and to distribute all external applied loads through the veneer to the adjacent building columns utilizing the column anchors.

Figure 1:
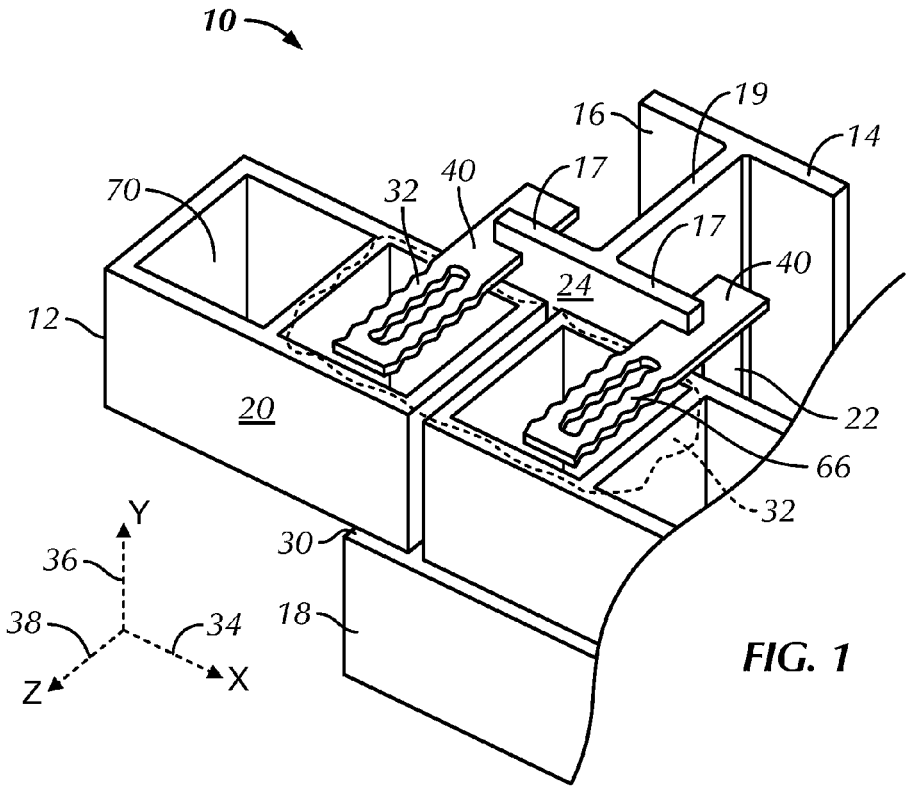
FIG. 1 is a perspective view of the first embodiment of the column anchor and anchoring system having a laser configured insertion portion emplaced in the bed joint of the adjacent masonry wall and secured to a steel column support structure.
Figure 2:
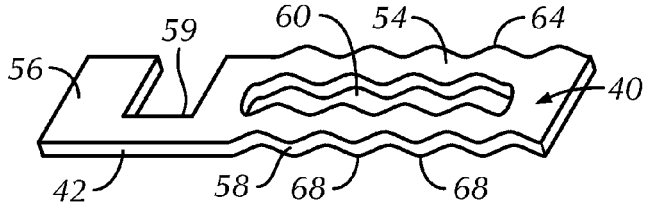
FIG. 2 is a perspective view of the column anchor of FIG. 1.
Figure 3:
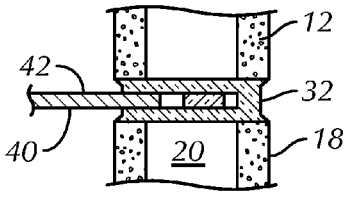
FIG. 3 is a partial cross-sectional view of the anchoring system of FIG. 1 on a substantially vertical plane showing one of the column anchors embedded in the masonry wall bed joint.

Referring now to FIGS. 1 through 3, the first embodiment of the laser configured column anchors and anchoring system of this invention is shown and is referred to generally by the number 10. In this embodiment, a wall structure 12 is shown having a building column support structure 14 of building columns 16 and an adjacent wall 18 of VCUs 20. The column structure 14 and the wall 18 are spaced apart by a predetermined space 22, which extends outwardly from the surface 24 of the building column structure 14. Optionally, the space 22 accommodates fireproofing (not shown) which is usually sprayed onto the building columns. Each of the building columns 16 has a flange 17 disposed on a central web 19 proximal to the wall 18.

In this embodiment, successive bed joints of mortar 30 and 32 are formed between VCUs 20. Courses of VCUs 20 and the bed joints 30 and 32 are substantially planar and horizontally disposed. For each wall 18, the bed joints 30 and 32 are specified as to the height or thickness of the mortar layer and such thickness specification is rigorously adhered to so as to provide the uniformity inherent in quality construction.

For purposes of discussion, the exterior surface 24 of the building column structure 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchors are constructed to restrict movement interfacially along the z-axis and along the x-axis. The device 10 includes a column anchor 40 constructed for attachment to the building column 16 and for embedment in bed joint 32, which, in turn, includes an elongated plate member 42 with an insertion portion 54 and an attachment portion 56.

The column anchor 40 is shown in FIG. 1 as being emplaced on a course of VCUs 20 and embedded within the bed joint 32 in FIG. 3. The elongated plate member 42 has a thickness of no greater than one-half of the bed joint 32 height and includes an insertion portion 54 with one or more apertures 60 therethrough to permit the mortar of the bed joint 32 to flow through and surround the elongated plate member 42. Opposite the insertion portion 54, the elongated plate member 42 includes an attachment portion 56, which anchors the wall 18 to the building columns 16. Either a single column anchor 40 or two column anchors 40 (as shown in FIG. 1) are be secured to the building column 16. The column anchor 40 of this embodiment is interchangeable as either a left-sided or right-sided column anchor 40. When the mortar of the bed joint 32 surrounds the column anchor 40, the mortar flows through the apertures 60 and provides strong interconnection and pullout resistance.

The elongated plate member 42 contains a peripheral edge portion 58 with a patterned edge portion 62 that is either regularly 64 or irregularly 66 patterned. An example of a regularly 64 patterned edge portion is shown in FIG. 2 as a saw tooth pattern 68. The attachment portion 56 includes an indentation or offset 59 for surrounding the edge of the proximal flanges 17. For enhanced holding, the patterned edge portions 62 are, upon installation, substantially parallel to x-axis 34. This relationship minimizes the movement of the construct in and along a z-vector and in an xz-plane. The column anchor 40 is a plate-like device constructed from mill galvanized, hot-dip galvanized, stainless steel or other similar high-strength material. The column anchors 40 are specially designed and laser configured to have a thickness of no greater than one-half the bed joint height 32 in the wall 18 so when inserted within the bed joint 32, the bed joint mortar surrounds the column anchor 40 filling the apertures 60 and the patterned edge portions 62, providing superior pullout resistance and providing a superior interconnect between the wall and the adjacent building column. When the VCUs 20 are masonry blocks with open cells 70, the additional mortar filling the cells 70 ensures even greater pullout resistance and interconnection with the wall 18.

The description which follows is of a second embodiment of the laser configured column anchors and high-strength anchoring system. For ease of comprehension, where similar parts are used reference designators "100" units higher are employed. Thus, the column anchor 140 of the second embodiment is analogous to the column anchor 40 of the first embodiment.

Referring now to FIGS. 3 through 5*b*, the second embodiment of the high-strength column anchor and anchoring system is shown and is referred to generally by the numeral 110. In this embodiment, a wall structure 112 is shown having a building column support structure 114 of building columns 116 and an adjacent wall 118 of VCUs 120. The building column structure 114 is shown spaced from the wall 118. The surface 124 of the building column structure 114 lies substantially in a plane parallel to that of the adjacent surface of wall 118. Each of the building columns 116 has a flange 117 disposed on a central web 119 proximal to the wall 118.

In this embodiment, successive bed joints of mortar 130 and 132 are formed between VCUs 120. Courses of VCUs 120 and the bed joints 130 and 132 are substantially planar and horizontally disposed. For each wall 118, the bed joints 130 and 132 are specified as to the height or thickness of the mortar layer and such thickness specification is rigorously adhered to so as to provide the uniformity inherent in quality construction.

For purposes of discussion, the exterior surface 124 of the building column structure 114 contains a horizontal line or x-axis 134 and an intersecting vertical line or y-axis 136. A horizontal line or z-axis 138, normal to the xy-plane, also passes through the coordinate origin formed by the intersecting x- and y-axes. In the discussion which follows, it will be seen that the various anchors are constructed to restrict movement interfacially along the z-axis and along the x-axis. The device 110 includes a column anchor 140 constructed for attachment to the building column 116 and for embedment in bed joint 132, which, in turn, includes an elongated plate member 142 with an insertion portion 154, a rotated portion 155 and an attachment portion 156.

Figure 4:
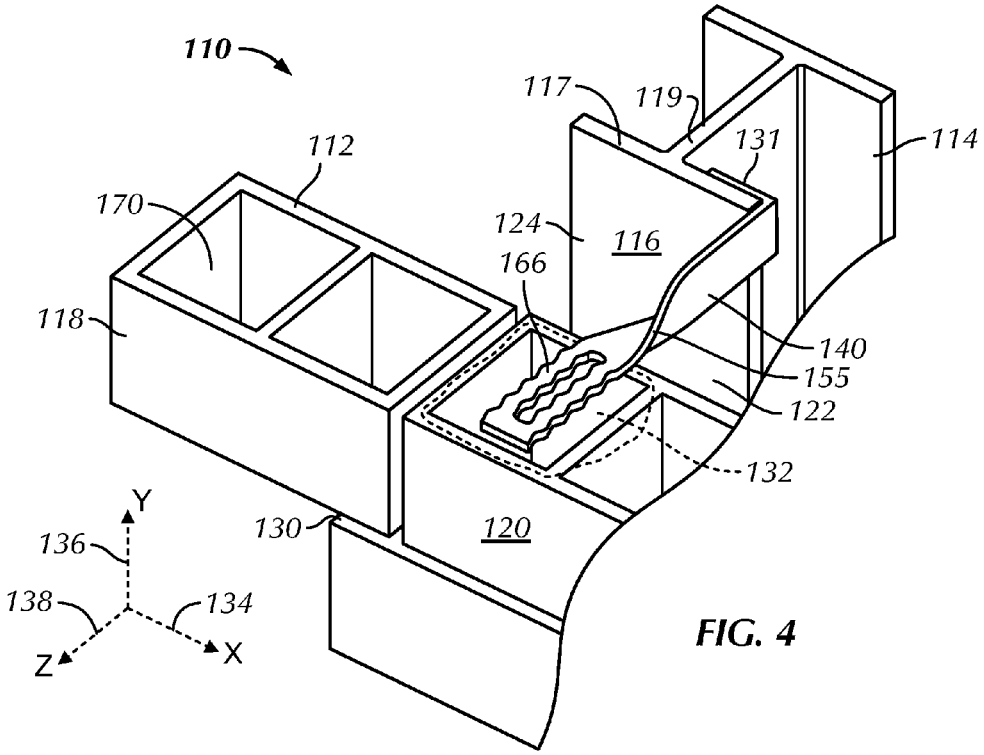
FIG. 4 is a partial perspective view of the second embodiment of the column anchor and anchoring system having a laser configured insertion portion emplaced in the masonry wall bed joint and secured to a steel column support structure.

The column anchor 140 is shown in FIG. 4 as being emplaced on a course of VCUs 120 and embedded within the bed joint 132 (as shown in FIG. 3). The elongated plate member 142 has a thickness of no greater than one-half of the bed joint 132 height and includes an insertion portion 154 with one or more apertures 160 therethrough to permit the mortar of the bed joint 132 to flow through and around the elongated plate member 142. A rotated portion 155 is contiguous with the insertion portion 154. The rotated portion 155 enables the insertion portion 154 to maintain parallelism with the bed joint 132 when attached to the column structure 114. Opposite the insertion portion 154 and contiguous with the rotated portion 155, the elongated plate member 142 further includes an attachment portion 156 which interengages with the building columns 116. The attachment portion 156 is formed from the elongated plate member 142 and contains a substantially 90 degree angle offset 131 which provides interengagement with the flange 117. The attachment portion 156 provides a secured attachment that resists pullout and movement along the z-axis 138. When the mortar of the bed joint 132 surrounds the column anchor 140, the mortar flows through the apertures 160 and provides a strong interconnect and high-pullout resistance.

Figure 5B:
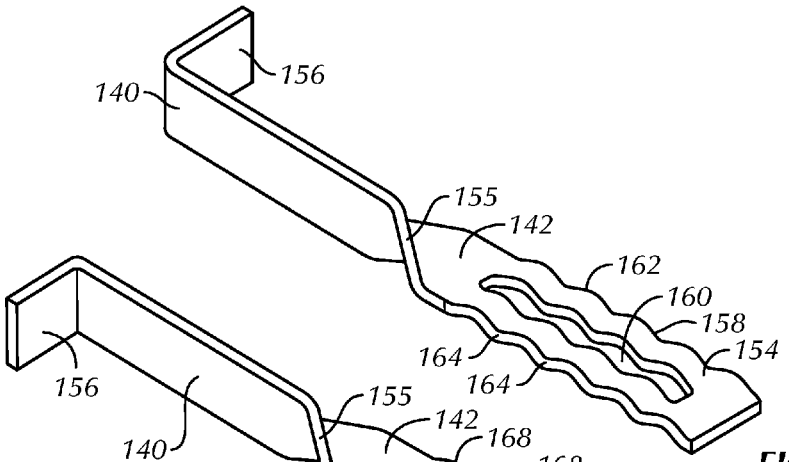
FIG. 5*b* is a perspective view of a column anchor similar to FIG. 5*a* with a left side orientation.
Figure 5A:
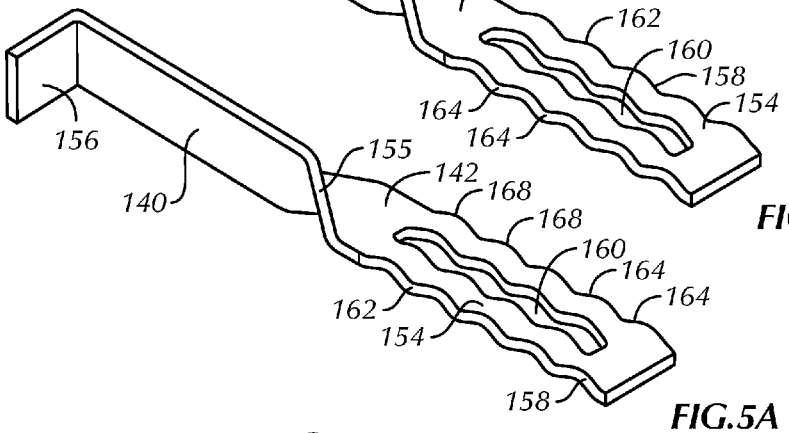
FIG. 5*a* is a perspective view of the column anchor of FIG. 4 with a right side orientation.

The elongated plate member 142 contains a peripheral edge portion 158 with a patterned edge portion 162 that is either regularly 164 or irregularly 166 patterned. An example of a regularly 164 patterned edge portion is shown in FIGS. 5*a* and 5*b* as a saw tooth pattern 168. For enhanced holding, the patterned edge portions 162 are, upon installation, substantially parallel to x-axis 134. This relationship minimizes the movement of the construct in and along a z-vector and in an xz-plane.

The column anchor 140 is a plate-like device constructed from mill galvanized, hot-dip galvanized, stainless steel or other similar high-strength plate material. The column anchors 140 are specially designed and laser configured to have a thickness of no greater than one-half the bed joint height 132 of the wall 118 so when inserted within the bed joint 132, the bed joint mortar surrounds the column anchor 140 and fills the apertures 160 and patterned edge portions 162, providing superior pullout resistance and interconnection between the wall 118 and the adjacent building column 114. When the VCUs 120 are masonry blocks with open cells 170, the additional mortar filling the cells 170 ensures even greater pullout resistance and interconnect with the wall 118. In this embodiment the column anchors 140 either have a right side orientation (as shown in FIG. 5*a*) or a left side orientation (as shown in FIG. 5*b*) for use on either edge of the proximal flange 117 allowing for flexibility in design and for multiple column anchor attachments.

The description which follows is of a third embodiment of the laser configured column anchors and high-strength anchoring system. For ease of comprehension, where similar parts are used reference designators "200" units higher are employed. Thus, the column anchor 240 of the third embodiment is analogous to the column anchor 40 of the first embodiment.

Referring now to FIGS. 3 and 6 through 9, the third embodiment of the high-strength column anchor and anchoring system is shown and is referred to generally by the numeral 210. In this embodiment, a wall structure 212 is shown having a building column structure 214 of building columns 216 and an adjacent wall 218 of VCUs 220. The building column structure 214 is shown space from the wall 218. The surface 224 of the building column structure 214 lies substantially in a plane parallel to that of the adjacent surface of wall 218. Each of the building columns 216 has a flange 217 disposed on a central web 219 proximal to the wall 218.

In this embodiment, successive bed joints of mortar 230 and 232 are formed between VCUs 220. Courses of VCUs 220 and the bed joints 230 and 232 are substantially planar and horizontally disposed. For each wall 218, the bed joints 230 and 232 are specified as to the height or thickness of the mortar layer and such thickness specification is rigorously adhered to so as to provide the uniformity inherent in quality construction.

For purposes of discussion, the exterior surface 224 of the building column structure 214 contains a horizontal line or x-axis 234 and an intersecting vertical line or y-axis 236. A horizontal line or z-axis 238, normal to the xy-plane, also passes through the coordinate origin formed by the intersecting x- and y-axes. In the discussion which follows, it will be seen that the anchors are constructed to restrict movement interfacially along the z-axis and along the x-axis. The system 210 includes a column anchor 240 constructed for attachment to the building column 216 and for embedment in bed joint 232, which, in turn, includes an elongated plate member 242 with an insertion portion 254, a rotated portion 255 and an attachment portion 256.

Figure 6:
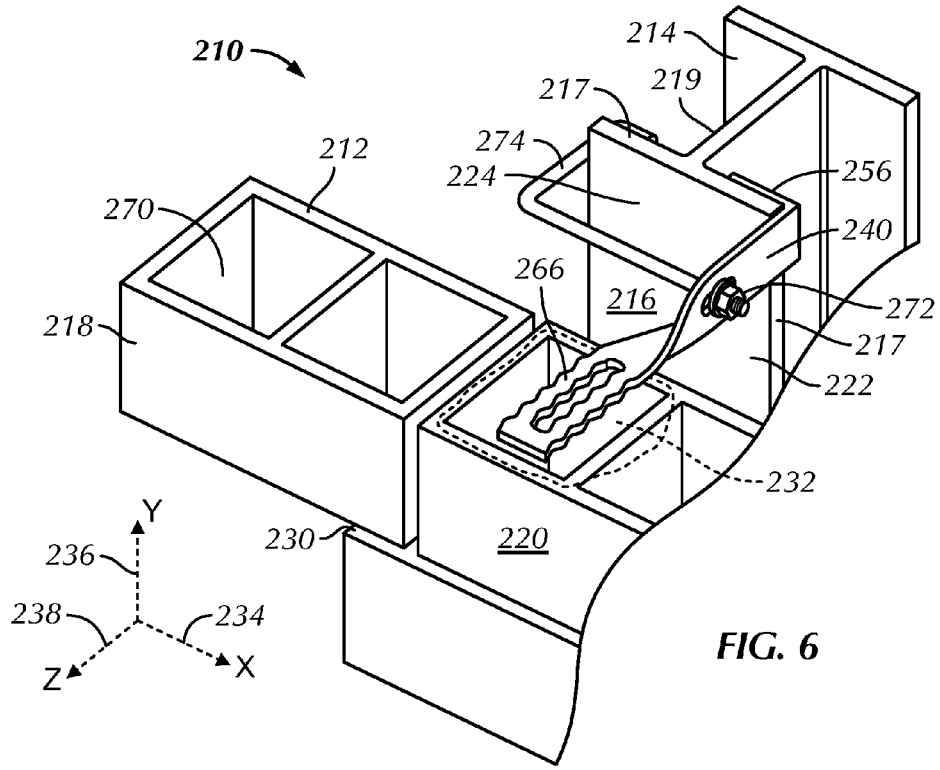
FIG. 6 is a partial perspective view of the third embodiment of the column anchor and anchoring system having a laser configured insertion portion emplaced within the masonry wall bed joint and secured to a steel column support structure, the column anchor includes a clamp.
Figure 8:
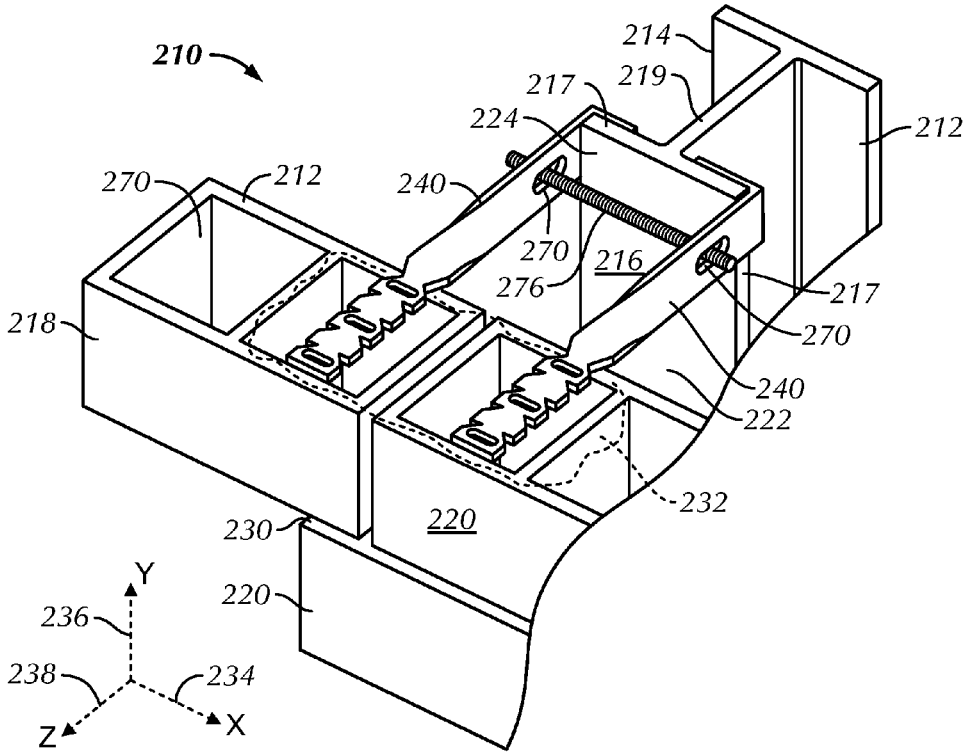
FIG. 8 is a perspective view of the anchoring system of FIG. 6 having two column anchors joined together by a securement bar; and, FIG. 9 is an exploded perspective view of the anchoring system of FIG. 8 having two column anchors, a securement bar and attaching hardware. The attachment portion has multiple apertures.

The column anchor 240 is shown in FIGS. 6 and 8 as being emplaced on a course of VCUs 220 and embedded within the bed joint 232 (as shown in FIG. 3). The elongated plate member 242 has a thickness of no greater than one-half of the bed joint 232 height and includes an insertion portion 254 with one or more apertures 260 therethrough to permit the mortar of the bed joint 232 to flow through and surround the elongated plate member 242. A rotated portion 255 is contiguous with the insertion portion 254. The rotated portion 255 enables the insertion portion 254 to maintain parallelism with the bed joint 232. Opposite the insertion portion 254 and contiguous with the rotated portion 255, the elongated plate member 242 further includes an attachment portion 256 which interengages the wall 218 and the building columns 216. The attachment portion 256 is formed from the elongated plate member 242 and contains a substantially 90 degree angle offset 231 which provides interengagement with the flange 217 and a secured attachment that resists pullout and movement along the z-axis 238. The attachment portion 256 contains a slot 270 medial the elongated plate member 242.

Figure 7:
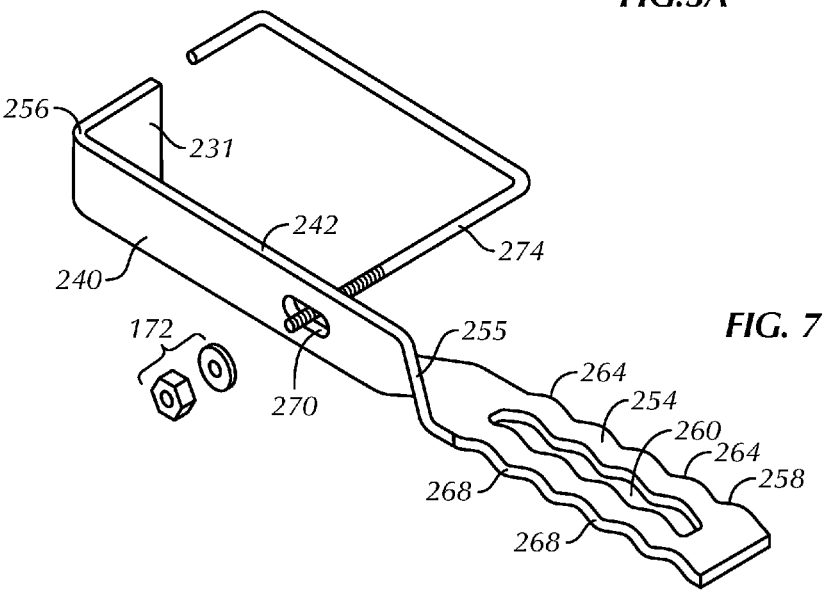
FIG. 7 is an exploded perspective view of the column anchor and clamp of FIG. 6.
Figure 9:
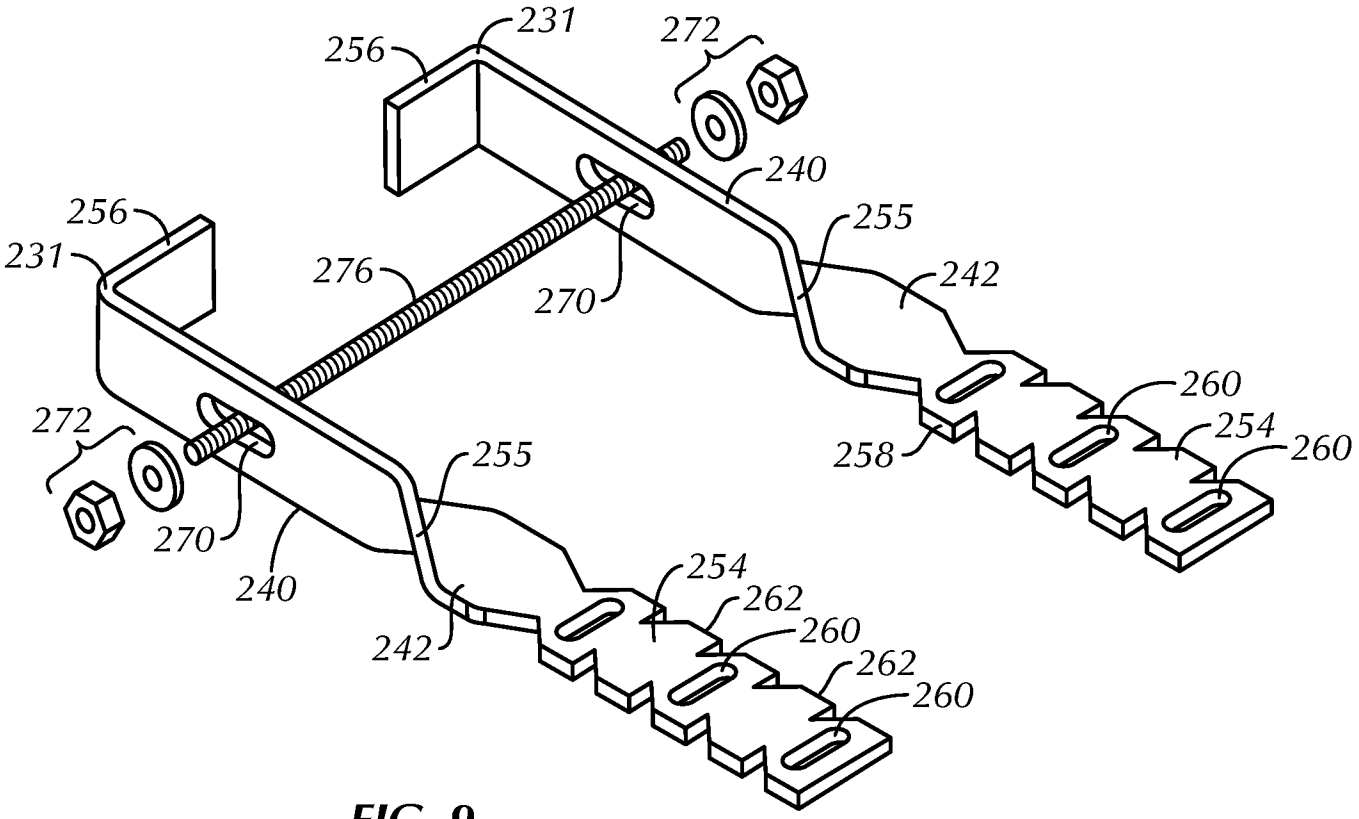

For greater column anchor 240 securement against the flanges 217, an L-shaped clamp 274 connects the column anchor 240 to the opposite flange through the slot 270. The clamp 274 is a wire formative and secured to the column anchor 240 with attaching hardware 272 as shown in FIGS. 6 and 7. The column anchor 240 has either a right side orientation (as shown in FIG. 6) or a left side orientation (as shown in FIG. 7) for use on either proximal flange 217, allowing for flexibility in design and for multiple column anchors attachments. Alternatively, as shown in FIGS. 8 and 9, both left-sided and right-sided column anchors 240 are interconnected with the flanges 217 and secured with a securement bar 276 inserted through the column anchor slots 270. The securement bar 276 is threaded to accommodate previously described hardware 272 and is secured to the column anchors 240 as shown in FIG. 9.

The elongated plate member 242 contains a peripheral edge portion 258 with a patterned edge portion 262 that is either regularly 264 or irregularly 266 patterned. An example of a regularly 264 patterned edge portion is shown in FIG. 7 as a saw tooth pattern 268. For enhanced holding, the patterned edge portions 262 are, upon installation, substantially parallel to x-axis 234. This relationship minimizes the movement of the construct in and along a z-vector and in an xz-plane.

The column anchor 240 is a plate-like device constructed from mill galvanized, hot-dip galvanized, stainless steel or other similar high-strength plate material. The column anchors 240 are specially designed and laser configured to have a thickness of no greater than one-half the bed joint height 232 in the wall 218, so when inserted within the bed joint 232, the bed joint mortar surrounds the column anchor 240 and fills the apertures 260 and patterned edge portions 262 providing superior pullout resistance and interconnection between the wall 218 and the adjacent building column 216. When the VCUs 220 are masonry blocks with open cells 270, the additional mortar filling the cells 270 ensures even greater pullout resistance and interconnection with the wall 218.

The present invention provides a novel improvement for column anchors. The laser cutting of the column anchor maintains the high-strength and durability of the metal anchors while providing precision cuts that allow for flow through reception of the bed joint mortar, enhancing pullout resistance within the wall bed joints. The bed joint and cell mortar completely surround the column anchors within the bed joint providing a solid interconnection within the wall.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A column anchor for anchoring a wall and adjacent building columns, each of the building columns having a central web disposed substantially perpendicular to the face plane of the wall and two flanges extending generally transverse to the central web, the wall having bed joints of mortar between volumetric construction units (VCU's), the column anchor comprising:

a plate member having a thickness, the plate member comprising:

a horizontal insertion portion at one end of the plate member, the insertion portion having one or more apertures therethrough disposed to permit the mortar of the bed joint to flow through and surround the insertion portion, the insertion portion having a thickness along a thickness axis and a peripheral edge including a plurality of recess formed in the peripheral edge of the insertion portion; and.

an attachment portion at the end of the plate member opposite the insertion portion and configured to anchor the wall to one of the building columns, the attachment portion including:

a first planar portion having a horizontal dimension along a horizontal axis, a vertical dimension along a vertical axis, the horizontal dimension and vertical dimension of the first planar portion defining a first plane and a thickness dimension along a thickness axis perpendicular to the first plane, the thickness dimension being smaller than both the horizontal dimension and the vertical dimension of the first planar portion; and a second planar portion having a horizontal dimension along a horizontal axis, a vertical dimension along a vertical axis, the horizontal dimension and the vertical dimension of the second planar portion defining a second plane perpendicular to the first plane and a thickness dimension along a thickness axis perpendicular to the second plane, the thickness dimension being smaller than both the horizontal dimension and the vertical dimension of the second planar portion, the thickness axis of the second planar portion being perpendicular to both the thickness axis of the first planar portion and the thickness axis of the horizontal insertion portion, the second planar portion being an offset formed as one piece of material with the plate member and configured to surround an edge of one of the flanges of the building column when the insertion portion is received in a bed joint of the wall, wherein the offset extends horizontally to surround the edge of the building column flange.

2. The column anchor of claim 1 wherein the plurality of recesses of the peripheral edge portion forms a regularly patterned edge to resist pullout from the bed joint.

3. The column anchor of claim 2 wherein the regularly patterned edge is a saw tooth pattern.

4. The column anchor of claim 1 wherein the plate member further comprises a rotated portion contiguous with the insertion portion and the attachment portion.

5. The column anchor of claim 4 further comprising:

a slot in the attachment portion and medial the plate member; and, an L-shaped clamp for securing the wall to the other one of the two flanges.

6. The column anchor of claim 5 wherein the L-shaped clamp is a wire formative and secured to the column anchor with attaching hardware.

7. A column anchor for connecting a wall and adjacent building columns, each of the building columns has a central web disposed substantially normal to the face plane of the wall and two flanges extending generally transverse to the central web, the wall having bed joints of mortar between volumetric construction units (VCU's), the column anchor comprising:

a plate member having a thickness, the plate member comprising:

a horizontal insertion portion at one end thereof, the insertion portion having one or more apertures therethrough disposed to permit the mortar of the bed joint to flow through and surround the plate member, the insertion portion having a peripheral edge including a plurality of recesses formed in the peripheral edge of the insertion portion;

a rotated portion contiguous with the insertion portion and enabling the insertion portion to maintain parallelism with the bed joint; and, an attachment portion at the end of the plate member opposite the insertion portion and contiguous with the rotated portion, the attachment portion being configured to engage one of the building columns to connect the wall to the building column, the attachment portion including:

a first planar portion having a horizontal dimension along a horizontal axis, a vertical dimension along a vertical axis, the horizontal dimension and vertical dimension of the first planar portion defining a first plane and a thickness dimension along a thickness axis perpendicular to the first plane, the thickness dimension being smaller than both the horizontal dimension and the vertical dimension of the first planar portion; and a second planar portion having a horizontal dimension along a horizontal axis, a vertical dimension along a vertical axis, the horizontal dimension and the vertical dimension of the second planar portion defining a second plane perpendicular to the first plane and a thickness dimension along a thickness axis perpendicular to the second plane, the thickness dimension being smaller than both the horizontal dimension and the vertical dimension of the second planar portion, the thickness axis of the second planar portion being perpendicular to both the thickness axis of the first planar portion and the thickness axis of the horizontal insertion portion, the second planar portion being an offset formed as one piece of material with the plate member and configured to surround an edge of one of the flanges of the building column when the insertion portion is received in a bed joint of the wall.

8. The column anchor of claim 7 wherein the plurality of recesses of the peripheral edge forms a regularly patterned edge to resist pullout from the bed joint.

9. The column anchor of claim 8 wherein the regularly patterned edge is a saw tooth pattern.

10. The column anchor of claim 7 further comprising:

a slot in the attachment portion and medial the plate member; and, an L-shaped clamp for securing the wall to the other one of the two flanges.

11. The column anchor of claim 10 wherein the L-shaped clamp is a wire formative and secured to the column anchor with attaching hardware.

12. The column anchor of claim 7, in combination with a second plate member having a thickness, the second plate member comprising:

an insertion portion at one end thereof, the insertion portion having one or more apertures therethrough disposed to permit the mortar of the bed joint to flow through and surround the second plate member;

a rotated portion contiguous with the insertion portion and enabling the insertion portion to maintain parallelism with the bed joint;

an attachment portion at the end of the second plate member opposite the insertion portion and contiguous with the rotated portion, the attachment portion being configured to engage one of the building columns to connect the wall to the building column; and, a securement bar configured to extend between and interconnect the plate member and the second plate member.

13. The column anchor of claim 12 wherein the securement bar is a wire formative and secured to each plate member with attaching hardware.

14. The column anchor of claim 12, wherein each plate member further comprises a slot in the attachment portion and medial the plate member, the securement bar being configured to extend through the slot in each plate member to interconnect the plate members.

15. The column anchor of claim 7, wherein the offset extends horizontally to surround the edge of the building column flange.

* * * * *